US005423198A

United States Patent [19]

DiVito et al.

[11] Patent Number: 5,423,198

[45] Date of Patent: Jun. 13, 1995

[54] DUAL CONTROL MODE LOCK

[75] Inventors: Thomas J. DiVito; Edward F. Humphrey, both of Southington, Conn.

[73] Assignee: Kaba High Security Locks, Inc., Southington, Conn.

[21] Appl. No.: 152,220

[22] Filed: Nov. 12, 1993

[51] Int. Cl.[6] ..... E05B 49/02

[52] U.S. Cl. ..... 70/278; 70/283

[58] Field of Search ..... 70/277–283, 70/276

[56] References Cited

U.S. PATENT DOCUMENTS

| | | | |
|---|---|---|---|
| 4,603,564 | 8/1986 | Kleinhäny et al. | 70/282 X |
| 4,658,105 | 4/1987 | Seckinger | 200/43.05 |
| 4,686,358 | 8/1987 | Seckinger et al. | 235/382 |
| 4,730,471 | 3/1988 | Seckinger et al. | 70/277 |
| 4,745,785 | 5/1988 | Uebersax | 70/279 |
| 4,761,976 | 8/1988 | Kleinhany | 70/277 |
| 4,771,620 | 9/1988 | Kleinhany | 70/277 |
| 4,789,859 | 12/1988 | Clarkson et al. | 70/278 X |
| 4,854,146 | 8/1989 | O'Connell et al. | 70/277 |
| 4,939,915 | 7/1990 | Vonlanthen | 70/279 X |
| 4,998,952 | 3/1992 | Hyatt, Jr. et al. | 70/395 |
| 5,140,317 | 8/1992 | Hyatt, Jr. et al. | 340/825.31 |

FOREIGN PATENT DOCUMENTS

| | | | |
|---|---|---|---|
| 0329931 | 8/1989 | European Pat. Off. | 70/278 |
| 2518618 | 6/1983 | France | 70/278 |
| WO88/00635 | 1/1988 | WIPO | 70/278 |

*Primary Examiner*—Lloyd A. Gall
*Attorney, Agent, or Firm*—Chilton, Alix & Van Kirk

[57] ABSTRACT

A security system requires the bringing together, at the locking mechanism to be operated from a locked to an unlocked state, of a properly bitted mechanical key and the generator of a digitally coded electrical command signal. The electrical command signal is transmitted through the lock to an actuator so that the lock, when enabled by insertion of the mechanical key, may be operated. The key may define a portion of the signal transmission path between the command signal generator and the actuator.

14 Claims, 6 Drawing Sheets

DUAL CONTROL MODE LOCK

BACKGROUND OF THE INVENTION

1. Field of the Invention

The present invention relates to improvements in access control and particularly to enhancing the security of locking systems by requiring that a pair of differently formatted access codes be simultaneously delivered to and recognized by a locking mechanism in order to cause the operation thereof. More specifically, this invention is directed to a hybrid security device, and especially a cylinder lock, which may be operated only when a properly bitted mechanical key is inserted in the keyway of the plug portion of the lock and an encoded electrical signal is simultaneously transmitted to and recognized by the device whereby one or more pin tumbler stacks which are not operated by the mechanical key will be displaced to the unlocked position. Accordingly, the general objects of the present invention are to provide novel and improved methods and apparatus of such character.

2. Description of the Prior Art

Mechanical locks which afford an exceptionally high degree of security, i.e., locks which are exceedingly difficult to defeat, are well known in the art. An example of such a lock, which is of the cylinder type, may be seen from FIG. 1 of U.S. Pat. No. 4,823,575. In situations where a high degree of security is required, locks of the type shown in U.S. Pat. No. 4,823,575 are desirable because the security offered by the lock may be enhanced by periodic replacement of the cylinder or plug portion of the lock, i.e., the lock may be rekeyed. There are, however, many applications where the security afforded by a lock which is responsive to a single access control device, such as a key operated mechanical lock, is considered insufficient.

Electromagnetically activated security devices have also previously been proposed and, in some cases, actually constructed and installed. These electromagnetically activated devices have employed a solenoid and associated plunger to perform a latching function, i.e., either the solenoid plunger functioned as a bolt or the state of energization of the solenoid determined whether a bolt could be moved. Examples of prior art electromagnetically activated security devices may be seen from U.S. Pat. Nos. 4,603,564, 4,730,471, 4,761,976 and 5,140,317. The prior art electromagnetically activated security devices were generally characterized by volumetric inefficiency, the possibility of defeating the lock upon accidental or deliberate disabling of the solenoid actuator and by the use of a single access control device.

Electronic access control systems, i.e., systems which switch power to a solenoid of an electromechanically activated security device in response to recognition of an electronically transmitted access code, are also well known in the art. The more sophisticated of such electronic systems have the desirable attribute of a programmable access code. Some of the previously available electronic access control systems include mechanical keys having built-in electronics for providing a coded signal which is recognized, and responded to, by circuitry included within the cooperating lock. Such electronic access control systems have previously been sold by the assignee of the present invention under the trademarks "KABA NOVA" and "LEGIC".

Security systems have also been proposed wherein a single key, with built-in electronics, may be utilized to operate either a mechanical lock of the type disclosed in U.S. Pat. No. 4,823,575 or an electronic access control. Such systems could theoretically enhance security by requiring serial operation of mechanical and electronic locking devices.

The prior art has not provided a locking system wherein all of the protective features of both mechanical and electronic locks were incorporated into a single, volumetrically efficient locking device which, in order to be actuated from a locked to an unlocked condition, would have to substantially simultaneously recognize both a mechanical code, in the form of key cross-sectional profile and bitting, and an electronic code transmitted to the lock in some suitable manner. Such a highly desirable locking system would also be characterized by an inability to defeat the lock by disabling the electronic control, and particularly the electromagnetic actuator associated therewith, or by "picking" the mechanical lock.

It is to be noted that locking systems have previously been proposed which require the simultaneous presentation of two control devices in order to permit access. In a basic form, such systems are embodied in conventional safe-deposit boxes which require two mechanical keys to be simultaneously operated to afford access. Such prior locking systems which require plural simultaneous control actions, however, have typically also required the use of dual locks or have resorted to blocking motion of the bolt, as opposed to immobilizing the plug portion of a rekeyable cylinder lock, as one of the two locking mechanisms. Bolt immobilization is inefficient, relatively easy to defeat and relatively expensive from both a manufacturing and installation viewpoint. There has not previously been a locking system which, for operation, required the substantially simultaneous use of two dissimilar devices which are brought together to, in effect, form a composite key which would be used solely for the purpose of gaining entry, the two devices thereafter being maintained under the control of different individuals.

SUMMARY OF THE INVENTION

The present invention overcomes the above briefly discussed and other deficiencies and disadvantages of the prior art by providing a novel and improved security system wherein a single locking mechanism, i.e., a rekeyable cylinder-type lock, must simultaneously be provided with two codes in order to be operated from a locked to an unlocked state. In accordance with the invention, the first one of the coded signals is a mechanical format, and particularly comprises the profile of and bitting on the blade of a key. A proper key will "enable" the lock such that, upon receipt of the second coded signal, the plug may be rotated relative to the cylinder to actuate a bolt. A security system in accordance with the invention further includes at least one pin tumbler stack of the cylinder lock which is displacable in response to a coded electrical signal. In a preferred embodiment, the position of the pin tumbler stack(s) which are subject to electrical control is varied electromagnetically. The electromagnetically displacable pin tumbler stack(s), in the same manner as the mechanically operated pin tumblers of the cylinder lock, will prevent rotation of the plug relative to the cylinder until the second coded signal has been received and recognized while the first coded signal is present. The actuator(s)

for the electromagnetically displacable pin tumbler stack(s) is a solenoid(s) which is energized by control electronics associated with the lock in response to receipt of the correct second coded signal from an external source. This externally generated second signal will customarily be in digital format and, in a preferred embodiment, will be transmitted to the electronic control via a single conductive path which includes the lock and the key. Also in a preferred embodiment, the lock contains sufficient intelligence so that it may be reprogrammed so as to permit the second code to be changed without disassembly of the system.

BRIEF DESCRIPTION OF THE DRAWINGS

The present invention may be better understood and its numerous objects and advantages will become apparent to those skilled in the art by reference to the accompanying drawings wherein like reference numerals refer to like elements in the several figures and in which.

DESCRIPTION OF THE DISCLOSED EMBODIMENTS

Figure 1:
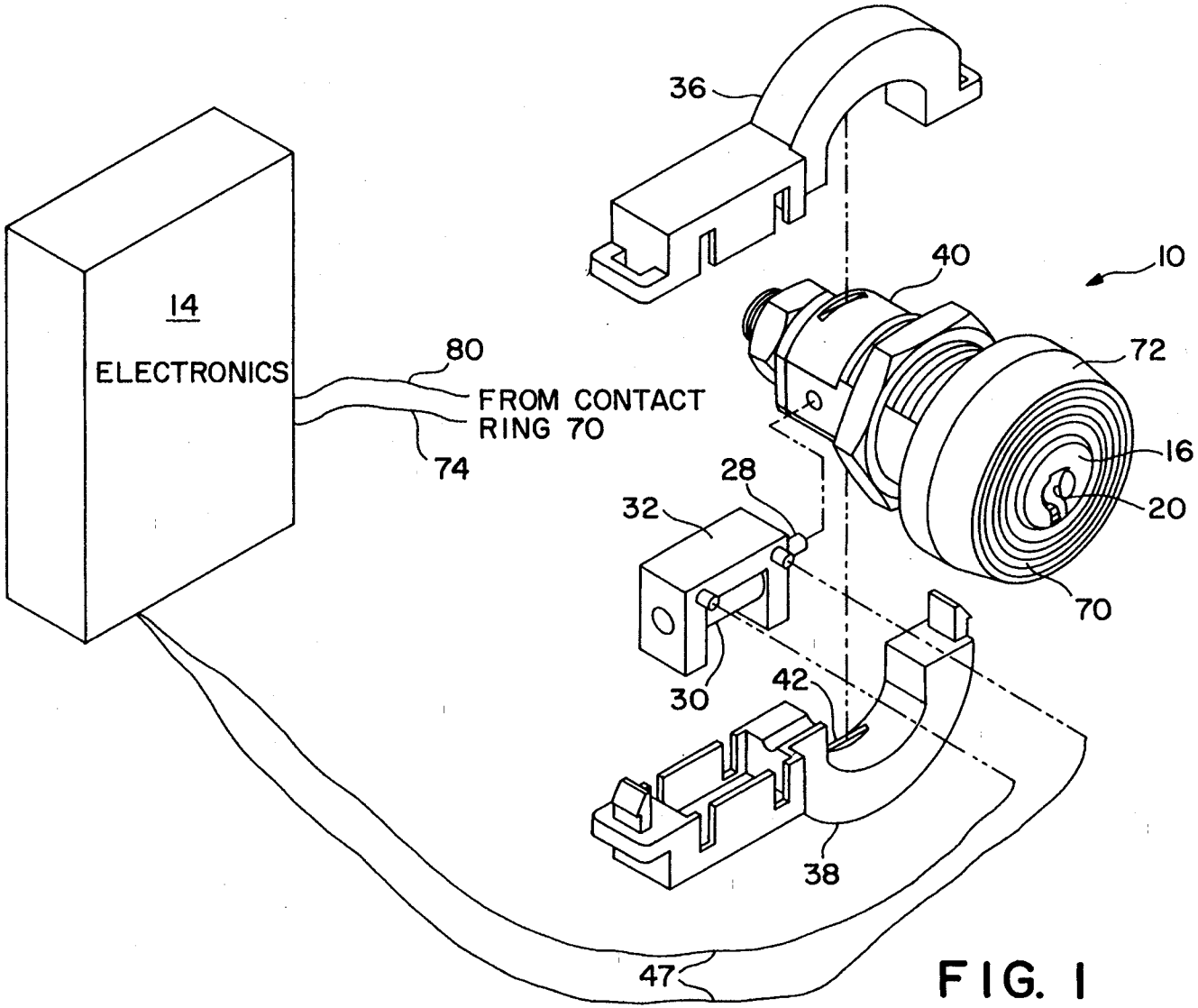
FIG. 1 is an exploded perspective view of a first embodiment of the lock of a security system in accordance with the present invention.
Figure 2:
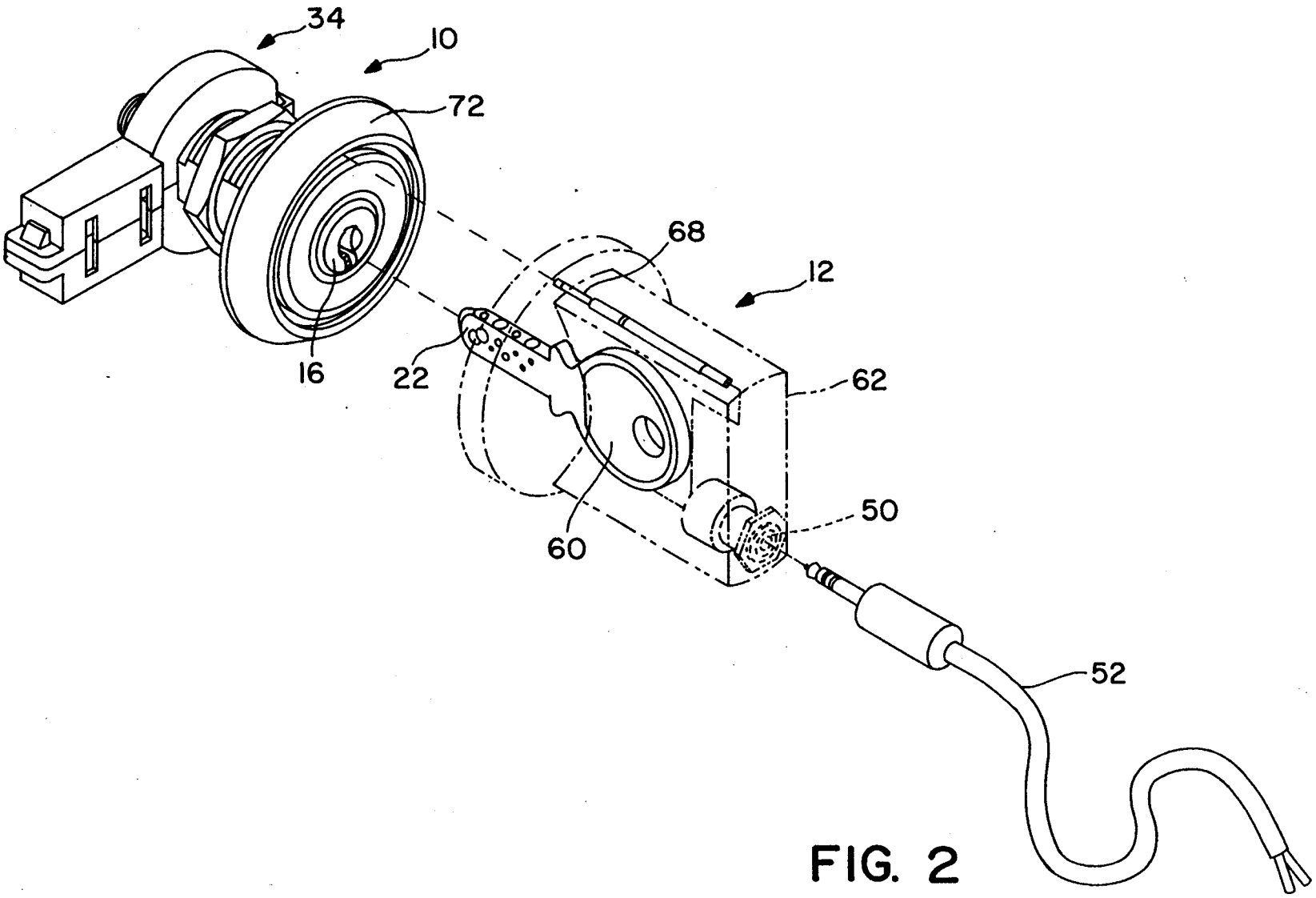
FIG. 2 is a perspective view, partly in phantom, of a key which may be utilized with the lock of FIG. 1, FIG. 2 also showing the lock in assembled condition.
Figure 3:
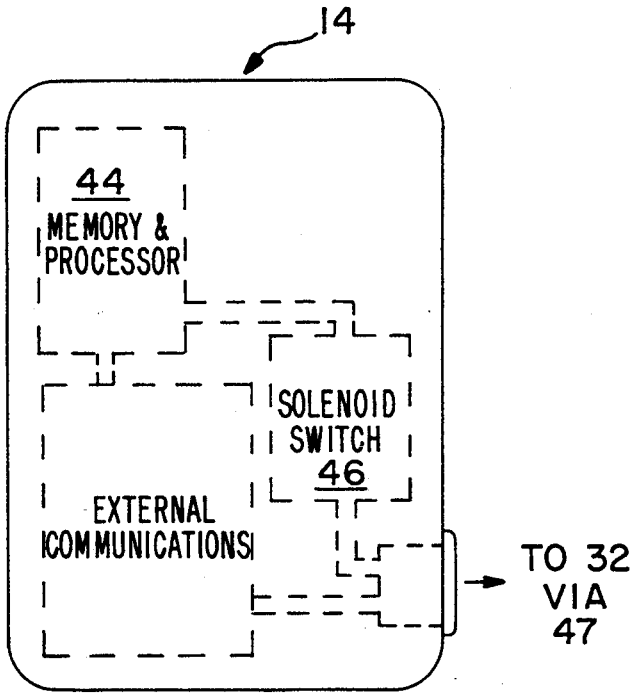
FIG. 3 is a circuit block diagram which schematically illustrates the control electronics of the lock of FIG. 1.

With reference now to the drawings, a security system in accordance with a first embodiment of the present invention comprises a lock, indicated generally at 10 in FIG. 1, a dual unit cooperating "key", indicated generally at 12 in FIG. 2, and a control module, indicated generally at 14 in FIG. 1. As will be described below, the control module 14 will be directly coupled to the lock 10, i.e., direct electrical connections for control signal and power transmission will be established in the manner depicted in FIG. 1. In the typical installation, the control module 14 will be installed in the same equipment which houses the lock. A digitally coded electrical control signal will, in the disclosed embodiments, be delivered to logic circuitry within module 14 via a conductive path established through the lock.

The lock 10 is a modified version of a cylinder type lock which may, for example, may be of the type disclosed in U.S. Pat. No. 4,823,575. Referring jointly to FIGS. 1 and 5, the cylinder lock includes a plug 16 which is rotatable in a cylinder 18, the plug defining a keyway 20. It will be understood that the lock 10 may be "rekeyed" by replacement of the cylinder and associated plug. The means by which such rekeying is accomplished is known in the art and has also been omitted from the drawings in the interest of facilitating understanding of the invention. It will further be understood that a tailpiece, not shown, will be mechanically coupled to the inwardly disposed end of the plug 16 for operating a bolt between the locked and retracted positions in response to rotation of plug 16 relative to cylinder 18.

Rotation of the plug 16 relative to cylinder 18 of lock 10 is accomplished by applying torque to a properly shaped and bitted blade 22 of a mechanical key which has been inserted into the keyway 20 in plug 16. In the disclosed embodiment the bitting on key blade 22 is in the form of a pattern of dimples of different size, depth and angular orientation in plural sides of the blade as shown in U.S. Pat. No. 4,823,575. These dimples cooperate with pin tumbler stacks 24 housed in the cylinder and plug of lock 10 such that, when a properly bitted key blade is inserted into the keyway, the shear lines between the cooperating bottom and driver pin tumblers of all of the mechanical key operated pin tumbler stacks will be in registration with a cylindrical interface between the plug and cylinder thus permitting plug rotation. The bitting on the key blade, accordingly, comprises the first of a pair of coded input signals which are required to operate lock 10. However, in accordance with the present invention, the insertion of a properly bitted key blade into lock 10 will not permit rotation of the plug 16 until at least one further pin tumbler stack, which may not be displaced via the keyway 20, has been displaced.

Figure 4:
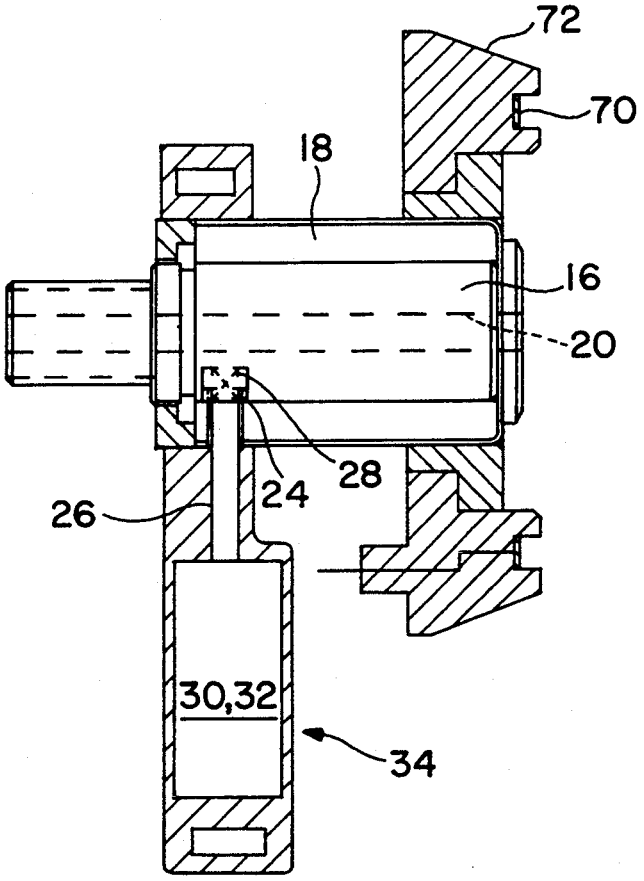
FIG. 4 is a top plan view partly in section, which depicts the cooperation between the solenoid actuator and cylinder lock portions of the lock of FIG. 1.
Figure 5A:
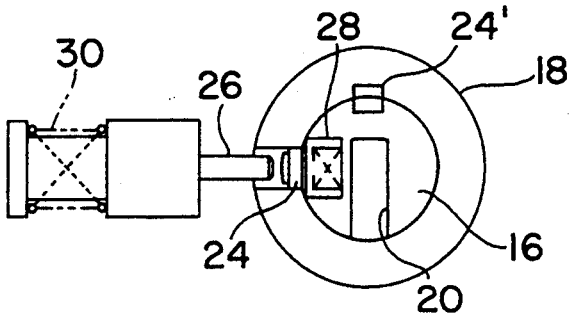
FIGS. 5A, 5B and 5C schematically illustrate the operation of the portion of the lock depicted in FIG. 4.
Figure 5B:
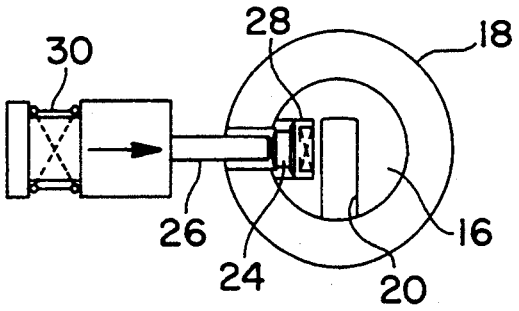
Figure 5C:
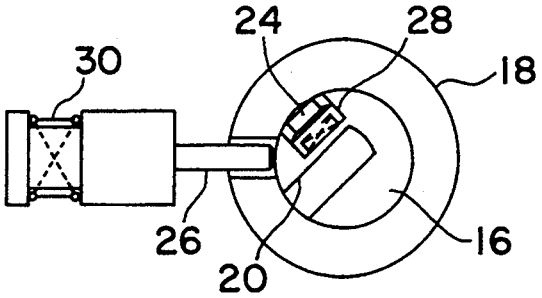

The above-mentioned further pin tumbler stack provided within lock 10 includes a spring biased bottom pin 24, which may be seen from FIG. 5A, and a cooperating driver pin 26. Bottom pin 24 is biased, by means of a spring 28, so as to normally extend across a shear line between plug 16 and cylinder 18 thus preventing plug rotation. As may be seen from FIGS. 4 and 5A, the pin chamber in the lock which accommodates the tumbler stack 24, 26 does not communicate with keyway 20. An extension of driver pin 26 is at least in part comprised of magnetic material and forms the plunger of a push-type solenoid 30. Bottom pin 24 will be pushed, against the bias of spring 28, into a receiving bore provided therefor in plug 16, i.e., to the position shown in FIGS. 5B and 5C, by energization of solenoid 30. FIG. 5A schematically shows pin 26 in the solenoid deenergized position corresponding to the locked state. FIGS. 4 and 5B show pin 24 in the depressed position resulting from the force provided by energizing solenoid 30, the motion of solenoid plunger being delivered to pin 24 by driver pin 26. As shown in FIG. 5C, the outer end of bottom pin 24 will ride on an inside diameter of cylinder 18 of lock 10 during rotation of plug 16 in response to the application of torque to the blade 22 after energization of solenoid 30.

The solenoid 30 is mounted in a holder 32 which, in turn, is received in a two piece housing indicated generally at 34 in FIG. 2. Housing 34 is defined by upper and lower clamp members 36 and 38 which may be fitted over holder 32 and snapped together. The outer shell 40 of the cylinder lock is provided with slots which receive locating projections 42 on clamp members 36 and 38, the cooperation between the slots and projections insuring proper positioning of the solenoid relative to the cylinder lock.

In accordance with the preferred mode of operation of the invention, in the manner to be described below and presuming that both coded control signals are simultaneously present, the solenoid 30 will be energized after full insertion of the key blade 22 into keyway 20.

The energization of solenoid. 30 needs to be only momentarily, i.e., once the plug 18 has been rotated a few degrees from the locked position the bottom pin 24 can not extend across the shear line until the plug is returned to the angular orientation commensurate with the locked condition.

To summarize the above, lock 10 may be operated from the locked to the unlocked condition only in response to simultaneous application of a pair of coded signals. The first of these signals is mechanically formatted, i.e., the first signal comprises the cross-sectional shape of and bitting on the key blade 22, while the second coded signal is a digitally coded electrical signal which is transmitted to the control electronics associated with the lock in the manner to be described below. The second signal will cause energization of solenoid 30 to displace the pin tumbler stack which includes bottom pin 24 whereby torque which is being applied to the blade 22 of a properly bitted key at the time of solenoid energization will cause rotation of the plug 16 relative to cylinder 18.

The control module 14 includes electronics in the form of a microprocessor 44, with associated memory, and a microprocessor controlled solid state switch 46 for energizing solenoid 30 via conductors 47. The memory associated with microprocessor will preferably be programmable from an external source and will store a changeable multi-digit code to which the lock is responsive. All power required for operation of the electronics within lock 10, and preferrably also for operation of the circuity associated with key 12, will be provided from an external source. This power source will typically be integral with the apparatus, for example a gambling machine, in which the lock 10 is installed.

Presuming that electrical operating power is present, an incoming data bearing signal will be compared by microprocessor 44 in control module 14, digit-by-digit, with the stored code. If a match is detected, a command signal will be generated by the microprocessor which will cause the solid state switch 46 to be "closed". The closing of switch 46 will establish a current flow path which includes the coil of solenoid 30 thereby energizing the solenoid and displacing the pin tumbler stack 24, 26 against the bias of spring 28 as described above. If desired, when the plug 16 is not rotated within a preselected time period after generation of the command signal for the solenoid control switch 46, for example because of incorrect bitting on key blade 22, the lock may be disabled for a period of time determined by instructions stored in the memory of microprocesor 44.

Figure 6A:
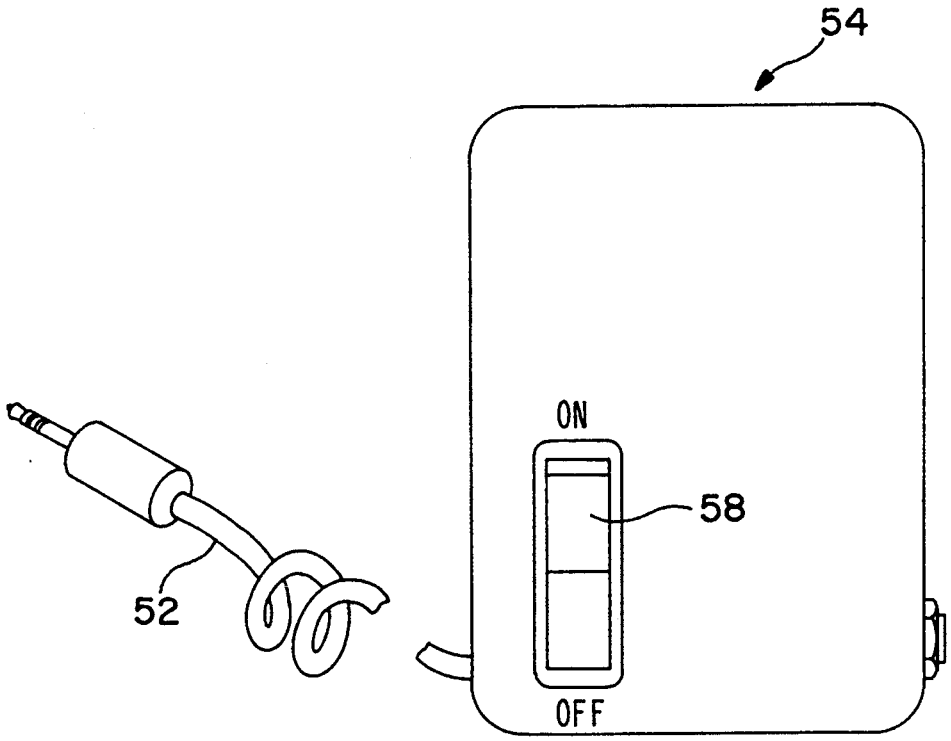
FIGS. 6A and 6B are respectively front and side elevation views of a command signal generator which is associated with the key of FIG. 2.
Figure 6B:
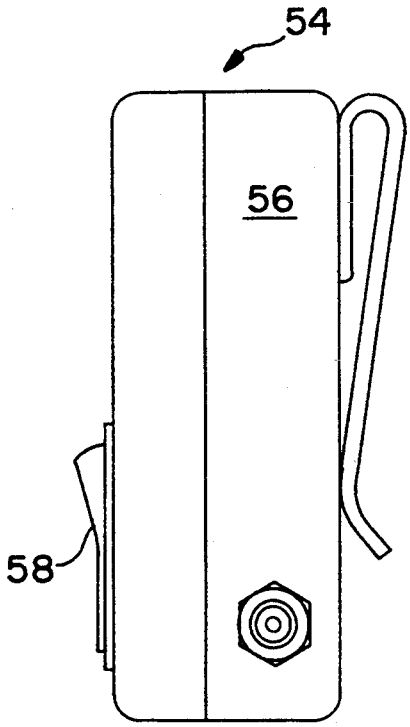

As discussed above, lock 10 may be operated only when both a key 12 with a properly bitted blade 22 and a means for transmitting a properly coded serial data stream to the electronics in lock 10 are simultaneously brought together. In the disclosed embodiment, and referring jointly to FIGS. 2, 6 and 7, key 12 is provided with a jack 50 having a pair of contacts. Jack 50 will be coupled, via a plug on the end of a two conductor cable 52, to a control signal generator 54 (FIG. 6A). In the disclosed embodiment, control signal generator 54 includes a microprocessor and associated communications circuitry. The control signal generator 54 may also include, but does not require, a rechargable battery pack 56. The control signal generator 54 will typically be pre-programmed so that the coded data signal to be transmitted to the lock 10 may be generated by operating a single switch 58. In the typical use environment, the control signal generator 54 will be carried by a first security officer while the mechanical key 12 will be carried by a second security officer.

Figure 7:
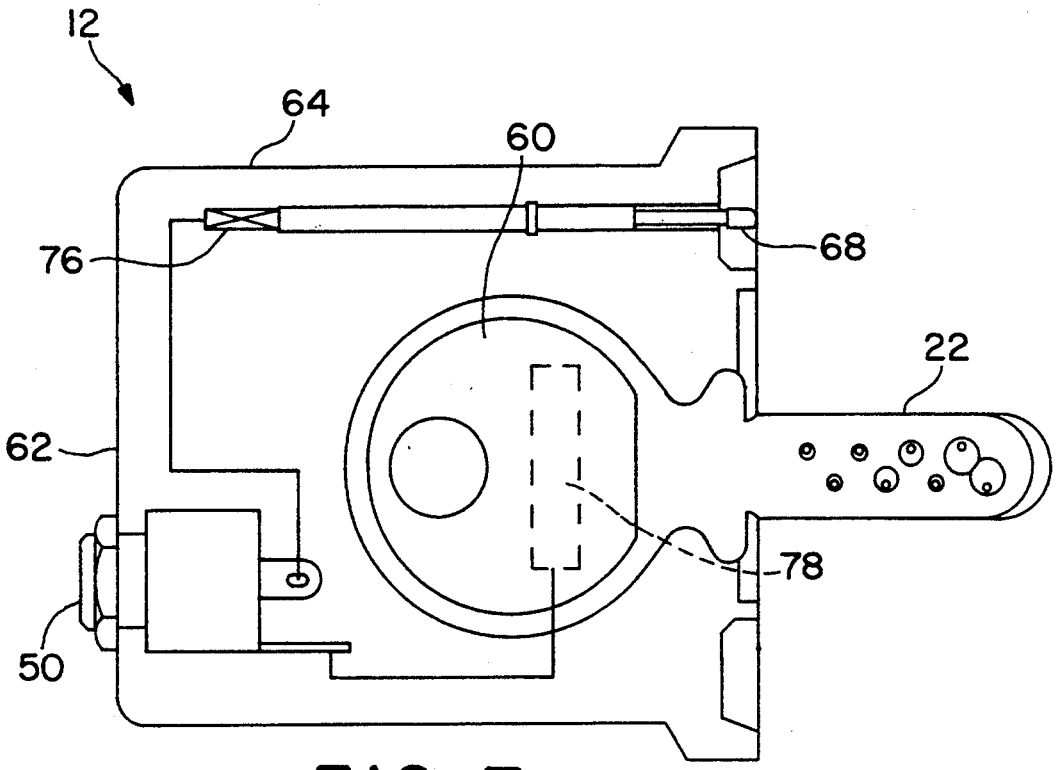
FIG. 7 is a cross-sectional side elevation view of the key of FIG. 2.
Figure 8:
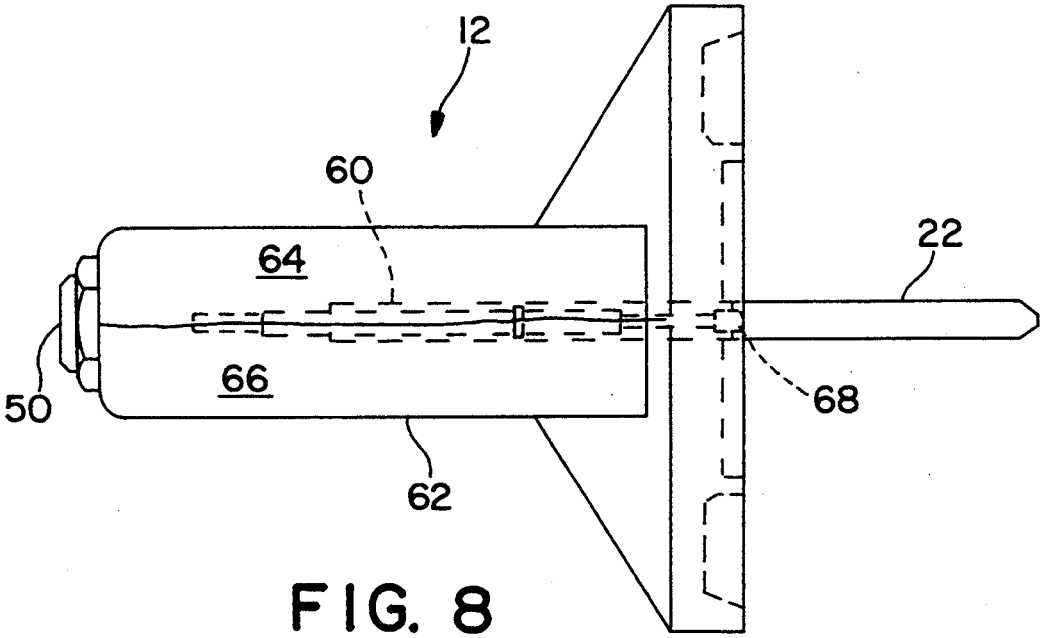
FIG. 8 is a top view of the key of FIG. 7.

Referring to FIGS. 2, 7 and 8, key 12 includes a matable combination of a mechanical key, comprising blade 22 and a bow portion 60, and an electrically insulated key holder 62. The key holder 62 is defined by a pair of housings defining molded plastic members 64 and 66 which are provided with recesses in the facing sides thereof. These recesses are sized and shaped to define a receiver for the bow 60 of the mechanical key. In the disclosed embodiment the key holder 62 is provided with a spring loaded contact pin 68 which cooperates with a contact ring 70 provided on the front face of cylinder 18 of lock 10. Contact ring 70, as best seen from FIG. 4, is received in an annular recess of a collar 72 provided about the front of lock 10. Collar 72 is comprised of a non-conductive material and, accordingly, ring 70 is electrically insulated from the lock. The contact ring 70 is connected, via an insulated conductor 74 which extends through a bore provided therefore in the collar 72 to control module 14.

Returning to a discussion of key 12, pin 68 is electrically connected to a first conductor of cable 52 via jack 50 as shown in FIG. 7. When key blade 22 is fully inserted in the keyway of lock 10, pin 68 will be urged against contact ring 70 by biasing spring 76 thus insuring a good electrical contact between the pin and ring. Also, the bow 60 of the mechanical key is sandwiched in key holder 62 so as to establish an electrical contact with a terminal 78 provided on holder defining member 64. Terminal 78 is electrically connected to jack 50 and, via jack 50, to the second conductor of cable 52. Thus, insertion of key blade 22 in the plug 16 of lock 10 will establish a complete electrical circuit for power and signal transmission between control module 14 and control signal generator 54 with the lock cylinder and mechanical key in part defining, in the disclosed embodiment, a first conductor 80 of this circuit.

In the operation of the disclosed embodiment, when the plug on the end of cable 52 is inserted in jack 50 and the key blade 22 has been inserted in the keyway 20 in plug 16, the encoded data stream may be transmitted from control signal generator 54 to control module 14, in the manner described above, a result of activation of switch 58.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A lock system comprising:

lock means, said lock means including a plug which is rotatable within a cylinder, the plug and cylinder each having an array of alignable first pin tumbler receiving chambers, said plug defining a keyway, the chambers of said first array in said plug and cylinder communicating with said keyway, primary pin tumbler stacks being disposed in at least of some of said chambers for displacement by a blade of a key inserted in said keyway, at least a first secondary pin tumbler stack receiving chamber in each of said plug and cylinder, said secondary chambers being in alignment when the chambers of said first array are in alignment, said secondary chambers being isolated from said keyway when said primary chambers are in alignment, a secondary pin tumbler stack disposed in said secondary receiving chambers, said secondary stack including at least a bottom pin tumbler and a driver pin tumbler, one of said pin tumblers of said secondary stack bridging the space between said plug and cylinder when the lock system is in the locked state;

actuator means for said secondary pin tumbler stack, said actuator means being normally deenergized and converting an applied electrical signal to motion when energized, said motion being delivered to said driver pin tumbler of said secondary stack to displace said stack to a position where a shear line between a pair of pin tumblers thereof is aligned with the space between said plug and cylinder;

means for generating an energizing signal for said actuator means, said energizing signal generating means being responsive to a coded electrical command signal;

key means, said key means including a blade which is bitted to define a coded mechanical signal whereby insertion of said blade into said keyway will cause displacement of said primary pin tumbler stacks to enable rotation of said plug relative to said cylinder upon generation of said energizing signal;

means for producing a coded electrical command signal for said energizing signal generating means; and means for establishing a pair of electrically conductive paths between said command signal producing means and said energizing signal generating means, said conductive paths extending through said lock means.

2. The system of claim 1 wherein a first conductor of said pair of conductive paths includes said key blade and lock means plug.

3. The system of claim 2 wherein said lock means further includes:

a first conductive terminal accessible at a front face of said lock means at a position displaced from said keyway; and a first conductor extending between said first terminal and said energizing signal generating means, said first conductor being electrically isolated from said plug and cylinder; and wherein said key means includes:

a mechanical key having a blade comprised of electically conductive material;

a key holder of non-conductive material;

means for establishing a first conductive path through said holder between said command signal producing means and said key blade;

contact means, said contact means being positioned and configured to engage said first conductive terminal when said key blade is fully inserted into said keyway; and means for establishing a second conductive path through said key holder between said command signal producing means and said contact means.

4. The system of claim 3 wherein said key holder includes socket means defining portions of said first and second conductive paths through said key holder and wherein said command signal producing means includes an electrical cable and plug means which mates with said socket means, said command signal producing means and said key means being separable and connected by said cable only for the purpose of operating said lock system.

5. The system of claim 3 wherein said contact means comprises a spring-loaded conductive pin.

6. The system of claim 4 wherein said contact means comprises a spring-loaded conductive pin.

7. The system of claim 1 wherein said lock means includes:

a first conductive terminal accessible at a front face of said lock means at a position displaced from said keyway; and a first conductor extending between said first terminal and said energizing signal generating means, said first conductor being electrically isolated from said plug and cylinder.

8. The system of claim 1 wherein said actuator means includes a solenoid.

9. The system of claim 8 wherein said energizing signal generating means includes microprocessor means for comparing received command signals with a stored authorized command signal.

10. The system of claim 9 wherein said lock means includes:

a first conductive terminal accessible at a front face of said lock means at a position displaced from said keyway; and a first conductor extending between said first terminal and said energizing signal generating means, said first conductor being electrically isolated from said plug and cylinder.

11. The system of claim 9 wherein a first conductor of said pair of conductive paths includes said key blade and lock means plug.

12. The system of claim 11 wherein said lock means further includes:

a first conductive terminal accessible at a front face of said lock means at a position displaced from said keyway; and a first conductor extending between said first terminal and said energizing signal generating means, said first conductor being electrically isolated from said plug and cylinder; and wherein said key means includes:

a mechanical key having a blade comprised of electically conductive material;

a key holder of non-conductive material;

means for establishing a first conductive path through said holder between said command signal producing means and said key blade;

contact means, said contact means being positioned and configured to engage said first conductive terminal when said key blade is fully inserted into said keyway; and means for establishing a second conductive path through said key holder between said command signal producing means and said contact means.

13. The system of claim 12 wherein said key holder includes socket means defining portions of said first and second conductive paths through said key holder and wherein said command signal producing means includes an electrical cable and plug means which mates with said socket means, said command signal producing means and said key means being separable and connected by said cable only for the purpose of operating said lock system.

14. The system of claim 13 wherein said contact means comprises a spring-loaded conductive pin.

* * * * *